US010710862B2

(12) United States Patent
Clüsserath et al.

(10) Patent No.: US 10,710,862 B2
(45) Date of Patent: Jul. 14, 2020

(54) METHOD FOR CONTROLLING A BEVERAGE FILLING SYSTEM

(71) Applicant: KHS GmbH, Dortmund (DE)

(72) Inventors: Ludwig Clüsserath, Bad Kreuznach (DE); Bernd Bruch, Weinsheim (DE)

(73) Assignee: KHS GmbH, Dortmund (DE)

( * ) Notice: Subject to any disclaimer, the term of this patent is extended or adjusted under 35 U.S.C. 154(b) by 22 days.

(21) Appl. No.: 16/095,063

(22) PCT Filed: Mar. 9, 2017

(86) PCT No.: PCT/EP2017/055527
§ 371 (c)(1),
(2) Date: Oct. 19, 2018

(87) PCT Pub. No.: WO2017/186395
PCT Pub. Date: Nov. 2, 2017

(65) Prior Publication Data

US 2019/0100423 A1 Apr. 4, 2019

(30) Foreign Application Priority Data

Apr. 25, 2016 (DE) ..... 10 2016 107 622

(51) Int. Cl.
*B65B 57/14* (2006.01)
*B67C 3/28* (2006.01)
(Continued)

(52) U.S. Cl.
CPC ..... *B67C 3/286* (2013.01); *B65B 3/30* (2013.01); *B65B 57/145* (2013.01); *B67C 3/007* (2013.01); *B67C 3/02* (2013.01); *B67C 3/26* (2013.01)

(58) Field of Classification Search
CPC ..... B67C 3/286; B67C 3/007; B67C 3/02; B67C 3/26; B65B 3/007; B65B 3/30
See application file for complete search history.

(56) References Cited

U.S. PATENT DOCUMENTS 6,378,575 B1 * 4/2002 Marchau ..... B67C 3/007 141/234
2005/0241726 A1 * 11/2005 Clusserath ..... B67C 3/286 141/144

(Continued)

FOREIGN PATENT DOCUMENTS

DE 28 48 988 5/1980
DE 41 17 287 12/1992

(Continued)

*Primary Examiner* — Timothy L Maust
*Assistant Examiner* — Jason K Niesz
(74) *Attorney, Agent, or Firm* — Occhiuti & Rohlicek LLP

(57) ABSTRACT

A method comprising controlling a beverage-filling system that comprises a filling machine with a ring bowl that feeds beverage to filling elements, each having a valve and a flow meter includes deriving a flow signal and using it to derive a regulating signal for regulating an inflow of beverage into the ring bowl, thereby maintaining a target level of beverage in the ring bowl. The flow signal comes from either summing signals from all flow meters to obtain aggregate quantity of beverage being filled into all containers or a calculation that relies on a measured speed of the filling machine, the number of filling elements in the filling machine, and the volumes of the bottles to be filled.

18 Claims, 2 Drawing Sheets

(51) Int. Cl.

| | |
|---|---|
| ***B65B 3/30*** | (2006.01) |
| ***B67C 3/02*** | (2006.01) |
| ***B67C 3/00*** | (2006.01) |
| ***B67C 3/26*** | (2006.01) |

(56) References Cited

U.S. PATENT DOCUMENTS

| | | | | |
|---|---|---|---|---|
| 2013/0306190 | A1 | 11/2013 | Tanaka | |
| 2015/0284234 | A1 * | 10/2015 | Meinzinger ..... | B67C 3/10 141/7 |

FOREIGN PATENT DOCUMENTS

| | | |
|---|---|---|
| DE | 699 14 094 | 10/2004 |
| GB | 733 819 | 7/1955 |
| JP | S62 168896 | 7/1987 |

* cited by examiner

METHOD FOR CONTROLLING A BEVERAGE FILLING SYSTEM

RELATED APPLICATIONS

This is the national-stage entry under 35 USC 371 of international application PCT/EP2017/055527, filed on Mar. 9, 2017, which claims the benefit of the Apr. 25, 2016 priority date of German application DE102016107622.8, the contents of which are herein incorporated by reference.

FIELD OF INVENTION

The invention relates to beverage filling systems, and in particular, to controlling the fill level of a beverage within a tank that holds the beverage.

BACKGROUND

In a filling system, there often exists a tank that holds a beverage that is to be used for filling containers, such as bottles or cans. This tank feeds numerous filling elements in parallel. During the filling process, it is important to regulate the extent to which this storage tank is filled with beverage. This is referred to as the tank's "fill level."

SUMMARY

The invention relates to filling machines that have a throughput of more than ten thousand containers per hour, and in particular a throughput of more than fifty thousand containers per hour. Examples of such filling machines are rotary filling machines.

An object of the invention is that of controlling such a filling machine to allow rapid and reliable regulation of how rapidly beverage flows into a storage tank that feeds the filling elements with beverage. The volumetric flow rate of beverage into the storage tank is referred to herein as the "inflow" or "beverage inflow."

In general, the filling machine's operating state changes from time to time. Changes in operating state can be accompanied by changes in the filling machine's angular velocity and interruptions in its beverage supply.

Filling elements around the periphery of the filling machine fill containers with the beverage. The storage tank supplies the beverage to all of these the filling elements. As it does so, the fill level of beverage in the storage tank will fall. It is therefore necessary to replenish this beverage. However, the replenishment should be carried out in a way that maintains the fill level in the storage tank.

The extent to which replenishment is required depends in large part on how quickly beverage is being drawn from the storage tank to fill containers. This is a time-varying quantity that is, to some extent, unpredictable. It is therefore useful to provide a signal indicative of this quantity as it varies in real time. Such a signal provides a basis for regulating inflow. The invention contemplates two methods for generating such a flow signal, referred to herein as a "current-volume-flow signal."

The first method involves the use of flow meters at each filling element. Each flow meter measures how much beverage a particular filling element has passed into containers. The values detected by the flow meters are added up to form the current-volume-flow signal. This results in a real-time summation signal as soon as the first container is filled. This summation signal provides a way to tell how much beverage is needed to replenish the supply in the storage tank.

Because it is being constantly updated in real time, this summation signal provides early detection of any changes in beverage requirements that result from changes to the filling machine's operating state.

A second method of generating such a flow signal involves measuring the filling machine's angular velocity and using it, together with the number of filling elements of the filling machine and the volume of a container to be filled, to calculate a current-volume-flow signal. A suitable formula is to multiply together the number of filling elements of the filling machine, the fluid volume of each container, and the angular velocity of the filling machine.

A filling machine as described herein has several modes of operation. Most of the time, it operates in the steady state. During steady state operation, angular velocity is essentially constant. However, the filling machine also operates during periods of transition. For example, there may be a period of transition between operating in one angular velocity and operating with another angular velocity. A special case is one in which the filling machine is just starting up, in which case one of the angular velocities is zero.

During these transition periods, the angular velocity varies. When the angular velocity predominantly increases, the machine is said to be "running up" to speed. When the angular velocity predominantly decreases, the filling machine is said to be "running down" or "winding down."

When the filling machine operates in steady state, the rate at which beverage leaves the storage tank and enters the containers does not change very much. This makes it easier to maintain the extent to which the storage tank is filled with a beverage. However, a difficulty arises during transition periods. During a transition periods, the rate at which the filling elements draw beverage from the storage tank may change. This tends to interfere with maintaining a constant level of beverage in the storage tank.

The invention features stored angular-velocity profiles that make it possible to determine beverage requirements before filling begins or at the very beginning of the filling process. The foregoing practices thus permit the regulation of beverage inflow into the storage tank from the very beginning of the filling process. This accounts for anticipated changes in the requirement for beverage during changes in the operational state of the filling machine.

The two practices described above result in a current-volume-flow signal, hereafter a "flow signal," that indicates how much beverage is being drawn from the storage tank at any instant. This flow signal provides a basis for deriving a regulating signal that regulates beverage inflow. In some embodiments, a central beverage inflow unit transfers the flow signal directly to a regulating circuit. The net result is regulation of the beverage inflow into the storage tank based at least in part on the flow signal.

An advantage of both practices described herein arises from the ability to know the volumetric flow at any instant with enough precision in real time to be able to regulate the inflow of beverage into the storage tank with minimal delay. This permits the level of beverage in the storage tank to be held within a narrow range regardless of the operating state and regardless of changes to that operating state.

The rapid response of the control system for the storage tank means that a valve that opens to admit additional beverage to the storage tank can open earlier. Thus, it is possible to begin replenishing the storage tank long before the replenishment could be triggered by, for example, detecting a falling fill level or a falling filling pressure. As a result, it is possible to keep the fill level in the storage tank and the filling pressure constant or very close to constant even when the filling system is just starting up or winding down and even in the event of a capacity change.

Once a summation signal is received, it is possible to replenish the storage tank at a rate consistent with that flow. This will lead to an essentially constant fill level in the storage tank.

However, in some cases, it may be desirable to increase the fill level in the storage tank. This can be achieved by adding an offset to the summation signal. This offset, which can be positive or negative, is used to correct the fill level in the storage tank. Through the use of relevant software, it is possible for this offset to vary with time as well, for example in response to some other feedback signal, such as a pressure signal or a fill-level signal.

When operating the filling machine, it is a simple matter to switch between the two alternative methods described herein, namely the method that relies on a summation signal from flow meter measurements and the method that relies on calculating a flow signal based on angular velocity during the run-up and winding-down phases that bracket steady-state operation.

In some embodiments, the inflow depends in part on a signal from a fill-level sensor in the storage tank in addition to depending on the flow signal. This means that a deviation from a desired fill level in the storage tank can immediately be compensated for by appropriately adjusting the inflow of beverage into the storage tank.

As used herein, regulation of beverage inflow includes regulating or controlling either or both a regulating valve arranged on a beverage-inflow line and a delivery pump that is arranged to pump beverage into the storage tank. The regulating valve and the delivery pump can be actuated separately or together.

In one embodiment, the filling machine is a circular filling machine that rotates at some measured angular velocity. Meanwhile, the beverage-filling system stores the filling machine's velocity profile, which includes velocity during the running up phase, when the filling machine transitions between being stationary and rotating at its steady-state velocity, and during the winding-down phase, when the filling machine transitions between rotating at its steady-state velocity and being stationary. It should be noted that angular velocity and circumferential velocity are interchangeable when the radius of the filling machine is known.

As the filling machine winds down, it is possible to calculate, in advance, based on the actual angular velocity, a current-volume-flow signal. Doing so includes using the stored velocity profile. It is therefore possible to regulate the volume rate-of-flow of beverage into the storage tank immediately and in a manner consistent with the decreasing flow as the filling machine's angular velocity decreases. This avoids having the beverage level in the storage tank rise as the volume drawn from the storage tank decreases during the winding down of the filling machine. This makes it possible to coordinate a winding down of beverage replenishment with the winding down of angular velocity in order to maintain a constant beverage level in the storage tank.

A similar phenomenon occurs as the filling machine is run up to its operating velocity. In that case, it is possible to anticipate the volume being drawn by the filling elements based on the angular velocity and the stored velocity profile, and, if necessary, from considering the angular velocity, the number of filling elements, and the volume of each container. This permits regulating the flow of beverage into the storage tank in anticipation of the forthcoming flow out of the tank, thus avoiding a time delay in increasing the volume rate of flow into the storage tank and avoiding a momentary drop in fill level that may otherwise result.

Some practices compare the filling machine's actual angular velocity during an operating state change with its target angular velocity as stored in memory and derive, from that comparison, a suitable correction signal that can be used to regulate the inflow of beverage into the storage tank. The beverage-filling system then controls the rate at which beverage flows into the storage tank based on that correction signal. This correction signal provides a way to compensate for any deviations between the actual angular velocity and the target angular velocity by adjusting the rate at which beverage enters the storage tank in response to such deviations. This means that the rate at which beverage flows into the storage tank will match the rate at which beverage leaves the storage tank to be placed into containers even when the angular velocity during a transition does not match the angular velocity that, according to the stored angular-velocity profile, would normally be anticipated during that transition.

Some practices feature updating the stored angular-velocity profile based on the measured angular velocity. This will allow the stored angular-velocity profile to evolve over time as the filling machine's performance changes from natural wear and tear. Thus, a particular filling machine, when new, will be installed with a starting angular-velocity profile. As the filling machine is used, this starting angular-velocity profile can be overwritten or modified to reflect actual performance.

In some practices, a beverage-inflow flowmeter at the product-inflow unit measures the volume rate-of-flow into the storage tank. The resulting measurement can be compared to the flow signal or to an anticipated flow signal to derive a correction signal for controlling the rate at which beverage flows into the storage tank. The stored velocity profiles are available for use as a reference in adjusting the beverage inflow.

Some practices include volumetrically filling containers. This means that the same volume is in each container regardless of the fill level in the container.

Some practices include volumetric filling of containers. This means filling the same volume of beverage in each container regardless of fill level. Volumetric filling permits easier calculation of actual flow rate for use in determining the flow signal.

In another aspect, the invention features a beverage-filling system that includes a filling machine and a storage tank for storing beverage. Preferably, the filling machine is a circular filling machine that rotates at some angular velocity and the storage tank is a ring bowl. The filling machine includes filling elements, each of which has a valve and a flow meter. The beverage-filling system also has a beverage-inflow unit that manages flow of beverage into the storage tank. The beverage-inflow unit includes a pump, a valve, or both. The pump pumps beverage towards the storage tank. The valve regulates the flow of beverage into the storage tank, thus regulating the volume that enters the storage tank. The product inflow unit receives beverage from a buffer tank or mixer that is quite large, with a volume of perhaps several cubic meters. As a result of each filling element having its own flow meter, it is possible to determine how the volume rate of flow out of the storage tank by adding the volume rates of flow measured by each flow meter in each filling element that is fed by the storage tank.

The beverage-filling system also includes a controller that regulates the flow of beverage into the storage tank and also controls the operation of the filling machine. Each flow meter of each filling element connects to the controller. The controller includes an adder that sums all flow measurements from the flow meters in the filling elements.

Within the controller is a beverage-regulating module that regulates the flow of beverage into the storage tank based on a current-volume-flow signal that is indicative of how fast beverage is leaving the storage tank. The beverage-regulating module causes the volume rate of flow into the storage tank to match the volume rate of flow out of the storage tank and into the containers.

In some embodiments, the beverage-regulating module adds an offset to the flow signal so as to cause a gradual change in the equilibrium beverage level within the storage tank. The offset is either positive or negative depending on whether the new equilibrium beverage level is higher or lower than the old one.

In some embodiments, there exists a filling-level sensor within the storage tank itself. In such embodiments, the beverage-regulating module regulates the rate at which beverage enters the storage tank at least in part based on a filling-level signal from this filling-level sensor.

Other embodiments control beverage inflow based on the current-volume-flow signal and on the fill level. As a result, it is possible to maintain the fill level in the storage tank within a narrowly defined range around a target filling-level. The range is selected to be compatible with operational safety of the filling machine.

Embodiments include those in which the flow meters in the filling elements are magnetically inductive flow meters. These are useful because they provide accurate measurements of flow rate.

In some embodiments, there exists a flow meter that is arranged to intercept beverage flow that is directed toward the storage tank. Such a flow meter generates an actual-inflow-volume flow signal that can be fed to the beverage-regulating module to derive a correction signal for regulating inflow of beverage into the storage tank. As a result, it is possible to constantly compare the measurement of beverage flow entering the storage tank and the current-volume-flow signal. This means that deviations can be cut early and corrected without significant delay. This, in turn, permits maintenance of a constant or essentially constant fill level within the storage tank.

An advantage of the present invention arises from the ability to regulate inflow of beverage with minimal delay. This results in a nearly constant beverage level within the storage tank during steady-state operation and also during operating phases in which the filling machine is running up to its operating velocity or winding down from its operating velocity.

Embodiments also included combinations of the foregoing features.

The following expressions are used synonymously herein: filling location and filling element; filling machine and circular filling-machine; beverage filling system, and beverage system, beverage filling-up system; and product container, tank, and ring bowl.

DETAILED DESCRIPTION

Figure 1:
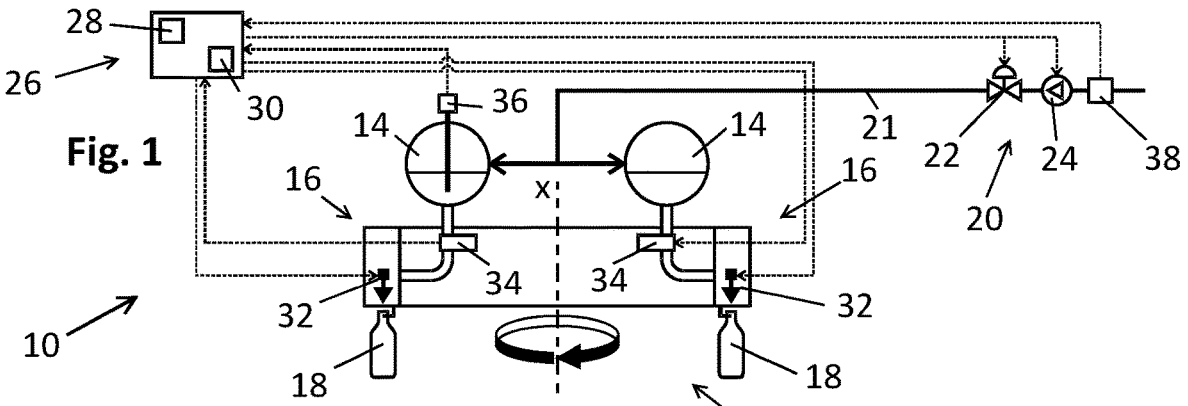
FIG. 1 shows a filling machine.
Figure 2:
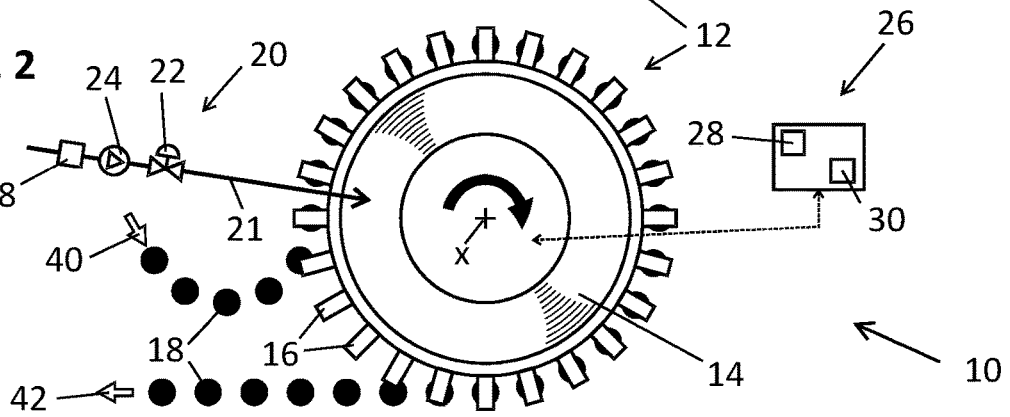
FIG. 2 shows a top view of the filling machine shown in FIG. 1.
Figure 3:
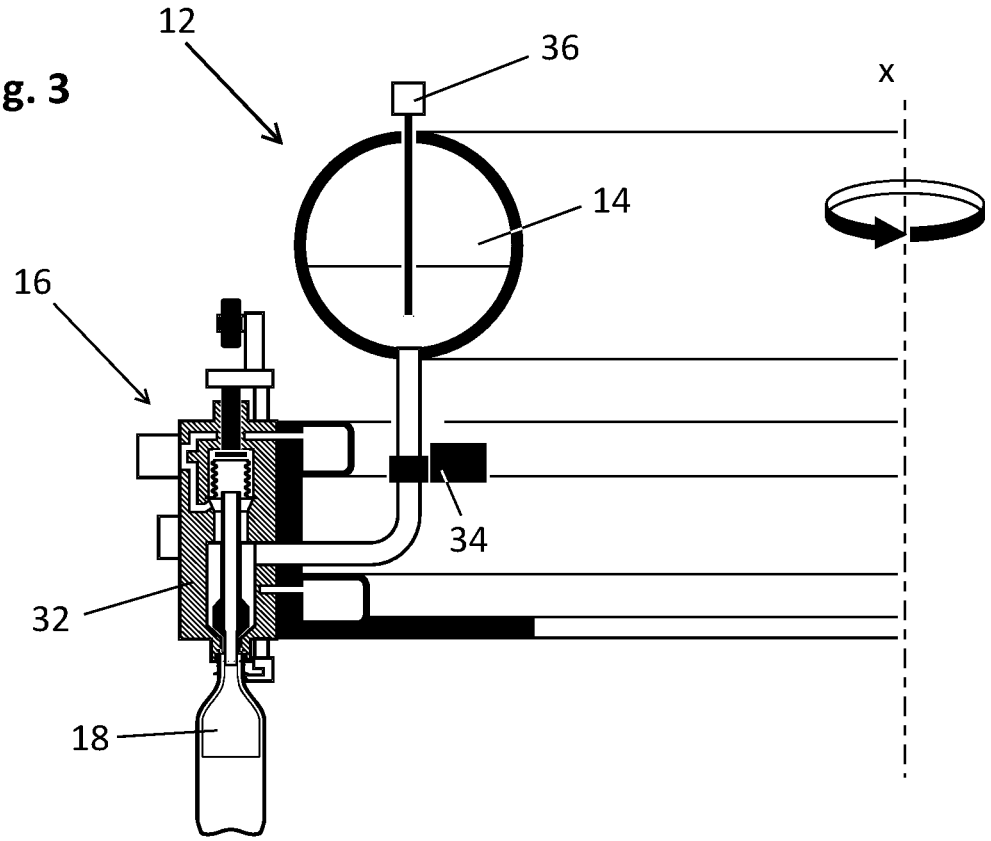
FIG. 3 shows details of a filling element from the filling machine shown in FIGS. 1 and 2.

FIGS. 1 and 3 show a beverage-filling system for filling containers 18, such as bottles, with a beverage. The beverage-filling system 10 includes a circular filling machine 12 that rotates about an axis thereof at some rotational velocity.

The filling machine 12 includes filling elements 16. These filling elements 16 define a second circle that is concentric with and larger than the first circle. In a typical filling machine 12, there may on the order of a hundred or so such filling elements 16. Each filling element 16 comprises a filling valve 32 that opens and closes to control delivery of beverage into a container 18. Each filling element 16 also comprises a filling-element flow meter 34 that measures how much beverage has flowed through the filling valve 32.

The filling machine 12 defines a first circle having a ring bowl 14 around a circumference thereof. The ring bowl 14 contains a reservoir of beverage. The ring bowl 14 feeds all of the filling elements 16 the product that they need for filling containers 18.

Having the ring bowl 14 be within the first circle is advantageous because centrifugal force developed during rotation of the filling machine 12 assists in the flow of beverage from the ring bowl 14 towards the filling elements 16. However, it is also possible to have at least a portion of the ring bowl 14 lie beyond the second circle. In some embodiments, the ring bowl 14 is beyond the second circle.

A beverage-inflow line 21 connects the ring bowl 14 to a inflow unit 20. The inflow unit 20 includes a regulating valve 22 and a delivery pump 24. The beverage-inflow line 21 ultimately connects to a large buffer tank of a mixer. The ring bowl 14 draws beverage from this buffer tank as needed.

A controller 26 that controls the beverage-filling system 10 features a memory 28 for storing the filling machine's filling curves. These filling curves are time-revolution-speed curves that provide information on filling characteristics associated with different rotational velocities at which the filling machine 12 rotates.

The memory 28 also stores other parameters. Among these other parameters are the number of the filling elements on the filling machine 12, the volume of the containers 18 to be filled, and target values or target-value ranges.

beverage-regulating module 30 that regulates the flow of beverage through the inflow unit 20 and thus regulates the delivery of beverage to the ring bowl 14. The controller 26 also connects to the filling valve 32 and to the filling-element flow meter 34.

The beverage-filling system 10 further comprises a beverage-level sensor 36 that connects to the controller 26. As a result, the controller 26 constantly receives a signal indicative of the level of the beverage that remains in the ring bowl 14. Also arranged in the beverage-inflow line 21 is a main flow-meter 38 that detects the volume rate of flow of beverage being conveyed to the ring bowl 14 at any time.

The filling machine 12 also includes a container inlet 40 through which containers are conveyed to the filling machine 12 and a container outlet 42 through which containers leave the filling machine 12. In some embodiments, the container inlet 40 and the container outlet 42 are transfer rotors.

In a first method of using the beverage filling-system 10, the controller 26 detects the filling machine's rotation velocity and uses it, together with the number of filling elements 16 and the filling volume of the container 18, to determine a current-volume-flow signal. The current-volume-flow signal then provides a basis for controlling either the regulating valve 22 or the delivery pump 24 or both, thus regulating the flow of beverage through inflow unit 20. This sets the quantity of beverage being delivered to the ring bowl 14 to match the quantity of product that is being filled into containers. As a result, the beverage level in the ring bowl 14 remains constant.

In a second method of using the beverage filling-system 10, the beverage-regulating module 30 of the controller 26 sums the individual volumes provided by the signals from flow meters 34 of all the filling elements 16 of the filling machine 12. This results in a current-volume-flow signal. The regulating valve 22 and the delivery pump 24 are then actuated in such a way that the beverage quantity being supplied to the ring bowl 14 is consistent with the sum of the values provided by the filling-element flow meters 34 of all the filling elements 16 as indicated by the current-volume-flow signal. This permits the inflow unit 20 to be regulated in real time, almost without any delay, to meet the volume-flow requirement that arises as the filling elements 16 fill containers.

It is possible to switch at will between the first and second methods of operation. For example, the first method may be particularly useful when the filling machine 12 is coming up to speed after having stopped operation or when the filling machine 12 is slowing down to a stop. The second alternative, which relies on the filling element's flow meters 34, is useful during steady-state operation of the beverage-filling system 10.

It is also possible to regulate beverage inflow in such a way that, instead of maintaining the beverage in the ring bowl 14 at some constant level, the beverage level is instead moved to a new level that will become the new constant level.

The invention is not restricted to the exemplary embodiment described heretofore, but can be varied at will within the scope of protection.

Having described the invention and a preferred embodiment thereof, what is claimed as new and secured by Letters Patent is:

1. A method comprising controlling a beverage-filling system that comprises a circular filling machine that comprises a ring bowl and a plurality of filling elements, each of which feeds a corresponding one of said bottles, wherein each filling element comprises a flow meter and a valve that controls flow of said beverage into a bottle, wherein said ring bowl feeds beverage to each filling element, wherein said filling machine is a circular filling machine that rotates at an angular velocity while said bottles are being filled, wherein said angular velocity undergoes variation as said circular filling machine slows down, wherein controlling said filling machine comprises deriving a current-volume flow signal either by summing signals from all flow meters to define an aggregate quantity of beverage being filled into said bottles or by carrying out a calculation that relies on a measured speed of said circular filling machine and on volumes of said bottles that are to be filled, using said current-volume flow signal to derive a regulating signal for regulating an inflow of beverage into said ring bowl, based at least in part on said regulating signal, regulating inflow of beverage into said ring bowl to maintain a target level of beverage in said ring bowl, storing said an angular-velocity profile indicative of said variation in said angular velocity, measuring a current angular velocity of said circular filling machine, based on said measured current angular velocity and said stored angular velocity profile, anticipating flow of beverage out of said ring bowl, and regulating said product inflow based at least in part on said anticipated flow of beverage out of said ring bowl.

2. The method of claim 1, wherein deriving said flow signal comprises deriving said flow signal based at least in part on said sum of signals from all flow meters, said sum defining an aggregate quantity of beverage being filled into said plurality of bottles.

3. The method of claim 1, wherein deriving said flow signal comprises deriving said flow signal based on said calculation that relies on said measured speed of said filling machine, said number of filling elements in said filling machine, and said volumes of said bottles to be filled.

4. The method of claim 1, wherein regulating said product inflow comprises regulating said product inflow based at least in part on a signal from a filling-level sensor arranged in said ring bowl.

5. The method of claim 1, wherein regulating said product inflow comprises regulating a beverage-delivery pump arranged in a beverage-inflow line that leads to said ring bowl.

6. The method of claim 1, wherein regulating said product inflow comprises regulating a valve that is arranged in a beverage-inflow line that leads to said ring bowl.

7. The method of claim 1, wherein said stored angular velocity profile is indicative of an angular-velocity profile that is followed by said filling machine as said filling machine runs up to an operating speed, wherein said method further comprises calculating an anticipated volume flow based at least in part on: said stored angular velocity profile, a target angular velocity, the number of filling elements in said filling machine, and an amount of beverage to be filled into each bottle in said plurality of bottles, and wherein said method further comprises, while said filling machine is being run up to said operating speed, regulating said product inflow at least in part based on said anticipated volume flow.

8. The method of claim 1, wherein said stored angular velocity profile is indicative of an expected velocity profile that occurs when said filling machine transitions between an operating state and a stationary state, wherein said method further comprises, during a transition between said stationary state and said operating state, comparing an actual revolution speed of said filling machine with a corresponding revolution speed from said stored angular velocity profile and, based at least in part on said comparison, regulating product inflow.

9. The method of claim 1, further comprising obtaining a first signal, obtaining a second signal, comparing said first and second signals, and based at least in part on said comparison, generating a correction signal for regulating product inflow, wherein said first signal is obtained from a product inflow meter and is indicative of a volume of beverage that is flowing into or out of said ring bowl.

10. The method of claim 1, further comprising obtaining a first signal, obtaining a second signal, comparing said first and second signals, and based at least in part on said comparison, generating a correction signal for regulating flow of beverage into said ring tank, wherein said first signal is obtained from a product inflow meter and is indicative of volume of beverage actually flowing into said ring bowl, and wherein said second signal is indicative of an anticipated volume of beverage that will flow out of said ring bowl during a transition of said filling machine between rotating in steady-state and being stationary.

11. The method of claim 1, further comprising filling a bottle with beverage by measuring a volume of beverage that is being filled into a bottle.

12. An apparatus comprising a beverage-filling system for filling bottles and a controller for controlling said beverage-filling system, said beverage filling-system comprising a filling machine, wherein said filling machine comprises a ring bowl and filling elements, each of which feeds a corresponding one of said bottles, wherein said filling machine is a circular filling machine that rotates at an angular velocity while said bottles are being filled, wherein said angular velocity undergoes a variation as said circular filling machine slows down, said variation being stored as an angular velocity profile, wherein said beverage-filling system further comprises beverage-inflow unit that comprises a delivery pump and a regulating valve, wherein each filling element comprises a filling-element flow meter, wherein said controller comprises a beverage-regulating module that comprises an adder that is configured to combine signals from said filling-element flow meters to form a flow signal, wherein said beverage-regulating module is configured to control said filling machine by deriving a current-volume flow signal either by summing signals from all flow meters to define an aggregate quantity of beverage being filled into said bottles or by carrying out a calculation that relies on a measured speed of said circular filling machine and on volumes of said bottles that are to be filled, to use said current-volume flow signal to derive a regulating signal for regulating an inflow of beverage into said ring bowl, and based at least in part on said regulating signal, to regulate inflow of beverage into said ring bowl to maintain a target level of beverage in said ring bowl, to measure a current angular velocity of said circular filling machine, based on said measured current angular velocity and said stored angular velocity profile, to anticipate flow of beverage out of said ring, and to regulate said product inflow based at least in part on said anticipated flow of beverage out of said ring bowl.

13. The apparatus of claim 12, wherein said beverage-filling system comprises a filling-level sensor in said ring bowl, wherein said beverage-regulating module regulates beverage inflow into said ring bowl at least in part based on a signal from said filling-level sensor, said signal being indicative of a filling level in said ring bowl.

14. The apparatus of claim 12, wherein said filling-element flow meter comprises a magnetically-inductive flow meter.

15. The apparatus of claim 12, further comprising a beverage-inflow flow meter that is arranged to measure beverage inflow through said beverage-inflow unit to said ring bowl, wherein said beverage-inflow flow meter provides an inflow-volume flow signal to said beverage-regulating module for use by said beverage-regulating module in generating said regulating signal.

16. A method comprising controlling a beverage-filling system that comprises a filling machine that fills bottles with a beverage, wherein said filling machine comprises a ring bowl and a plurality of filling elements, each of which feeds a corresponding one of said bottles, wherein each filling element comprises a valve and a flow meter, wherein each valve controls flow of said beverage into a bottle, wherein said ring bowl feeds beverage to each filling element in said plurality of filling elements, wherein controlling said filling machine comprises deriving a flow signal, said flow signal being a current-volume flow signal, using said flow signal to derive a regulating signal for regulating an inflow of beverage into said ring bowl, and based at least in part on said regulating signal, regulating inflow of beverage into said ring bowl to maintain a target level of beverage in said ring bowl, wherein deriving said flow signal comprises one of deriving said flow signal based at least in part on a sum of signals from all flow meters, said sum defining an aggregate quantity of beverage being filled into said plurality of bottles and deriving said flow signal based on a calculation that relies on a measured speed of said filling machine, the number of filling elements in said filling machine, and the volumes of said bottles to be filled, wherein said filling machine is a circular filling machine that rotates at an angular velocity, while said bottles are being filled, said angular velocity being defined by a curve that indicates variation of said angular velocity as said circular filling machine slows down, wherein said method comprises storing said curve, measuring a current angular velocity of said circular filling machine, based on said measured current angular velocity and said stored curve, anticipating flow of beverage out of said ring bowl, and regulating said product inflow based at least in part on said anticipated flow of beverage out of said ring bowl.

17. The method of claim 1, further comprising storing a curve that is indicative of an angular-velocity profile that is followed by said filling machine as said filling machine runs up to an operating speed and calculating an anticipated volume flow based at least in part on said curve, a target angular velocity, the number of filling elements in said filling machine, and amount of beverage to be filled into each bottle in said plurality of bottles, and, while said filling machine is being run up to said operating speed, regulating said product inflow at least in part based on said anticipated volume flow.

18. The method of claim 1, further comprising storing a curve that is indicative of an expected velocity profile that occurs when said filling machine transitions between an operating state and a stationary state, during a transition between said stationary state and said operating state, comparing an actual revolution speed of said filling machine with a corresponding revolution speed from said stored curve, and, based at least in part on said comparison, regulating product inflow.

* * * * *